US010806230B2

(12) United States Patent
Porter

(10) Patent No.: US 10,806,230 B2
(45) Date of Patent: Oct. 20, 2020

(54) OIL DISPENSING BEARD COMB AND ASSOCIATED METHODS OF MAKING THE SAME

(71) Applicant: Christopher Porter, Altamonte Springs, FL (US)

(72) Inventor: Christopher Porter, Altamonte Springs, FL (US)

( * ) Notice: Subject to any disclaimer, the term of this patent is extended or adjusted under 35 U.S.C. 154(b) by 463 days.

(21) Appl. No.: 15/400,089

(22) Filed: Jan. 6, 2017

(65) Prior Publication Data

US 2017/0196335 A1 Jul. 13, 2017

Related U.S. Application Data

(60) Provisional application No. 62/276,367, filed on Jan. 8, 2016.

(51) Int. Cl.

| | |
|---|---|
| ***A45D 24/28*** | (2006.01) |
| ***A45D 19/16*** | (2006.01) |
| *A45D 27/00* | (2006.01) |

(52) U.S. Cl.

CPC ..... *A45D 24/28* (2013.01); *A45D 19/16* (2013.01); *A45D 27/00* (2013.01)

(58) Field of Classification Search

CPC ..... A45D 24/22; A45D 24/28; A45D 19/16; A45D 19/02; A45D 2019/025; A45D 27/00; A46B 11/00; A46B 11/0037; A46B 11/0065; A46B 11/0093

USPC ..... 132/112–114

See application file for complete search history.

(56) References Cited

U.S. PATENT DOCUMENTS

| | | | | | |
|---|---|---|---|---|---|
| 1,354,143 | A * | 9/1920 | Stewart | A45D 24/24 | 132/114 |
| 2,270,530 | A * | 1/1942 | Kirschenbaum | A45D 24/22 | 132/112 |
| 2,381,048 | A * | 8/1945 | Habostad | A45D 19/02 | 132/113 |
| 2,539,634 | A * | 1/1951 | Pepin | A45D 24/28 | 132/114 |
| 2,737,190 | A * | 3/1956 | Magnusson | A45D 24/24 | 132/114 |
| 3,465,760 | A * | 9/1969 | Sobel | A45D 24/22 | 132/147 |
| 4,254,738 | A * | 3/1981 | Stanley | A46B 11/0055 | 119/604 |
| 4,934,855 | A * | 6/1990 | Recchelbacher | A46B 11/0055 | 132/148 |
| 5,927,290 | A | 7/1999 | Thiruppathi | | |
| 6,588,964 | B1 * | 7/2003 | Au | A45D 24/22 | 132/113 |
| 8,347,894 | B1 * | 1/2013 | Stewart | A45D 24/28 | 132/114 |
| 2015/0265025 | A1 * | 9/2015 | Alsalameh | A45D 24/22 | 132/113 |
| 2015/0272313 | A1 | 10/2015 | Alsalameh | | |

* cited by examiner

*Primary Examiner* — Heidi M Eide

(74) *Attorney, Agent, or Firm* — Allen, Dyer, Doppelt + Gilchrist, PA

(57) ABSTRACT

An oil dispensing beard comb includes a body, and teeth extending outwards from a lower portion of the body. The teeth have oil dispensing openings therein. A pump is carried by an upper portion of the body, and an oil bottle is coupled to the pump at the upper portion of the body. The body has at least one passageway therein extending between the pump and the oil dispensing openings in the teeth.

11 Claims, 8 Drawing Sheets

OIL DISPENSING BEARD COMB AND ASSOCIATED METHODS OF MAKING THE SAME

RELATED APPLICATIONS

This application claims the benefit of U.S. Provisional Application Ser. No. 62/276,367 filed Jan. 8, 2016, the entire contents of which are incorporated herein by reference.

FIELD OF THE INVENTION

The present invention relates to the field of hair combs, and more particularly, to an oil dispensing beard comb, and related methods for making the same.

BACKGROUND OF THE INVENTION

The cosmetic industry has developed many products that may be used to apply a liquid (oil, tonic, gel, etc.) to hair and the scalp. These products may also be applied to beards and the underlying skin. Although some products may be applied to the hair or beard, other products require that they be applied directly to the underlying scalp or skin.

One method of applying a treatment fluid directly to the scalp or skin is to spray the fluid onto the desired area and rub it in with one's hands. This method is often messy and inconvenient. Another method of delivering liquid to the scalp or skin is to place the liquid in a container having a relatively long spout. The person then squeezes the container with the spout adjacent the scalp or skin. One problem with this type of application is that the liquid often runs off the scalp or skin before it can be rubbed in.

Several liquid dispensing brushes have been developed. For example, U.S. published patent application no. 2015/0272313 to Alsalameh discloses a liquid-dispensing hair brush that includes an internal reservoir for a hair grooming liquid. The liquid (oil, tonic, gel, etc.) is released from the reservoir to pass through passages in the teeth or bristles of the brush, for application to the hair and scalp simultaneously with the brushing of the hair. Certain embodiments have controls upon the handles for releasing and/or pressurizing the contents of the reservoir to flow from the reservoir and out through the teeth and/or bristles. Another embodiment includes a pneumatic bulb for applying air pressure to the reservoir. Yet another embodiment includes an internal plate with a series of stops extending therefrom, with the stops corresponding to the internal pores of each of the teeth or bristles. A handle extends from the plate through the back of the brush for control of the flow of liquid from the reservoir.

U.S. Pat. No. 5,927,290 to Thiruppathi discloses a liquid dispensing hair brush that includes a body having a chamber therein, and a liquid container in the chamber. A trigger is also contained within the chamber. A pump is disposed in the container to dispense liquid from the container through a spray nozzle when the container is driven by the trigger. The pump and container are disposed in the head portion of the brush such that the pump stroke may be relatively short. The container may be removable and replaceable or refillable.

The above disclosed liquid dispensing brushes are directed for applying a liquid to the hair on one's head and/or the underlying scalp. These liquid dispensing brushes are not readily applicable to beards. Consequently, there is a need for a liquid dispensing beard comb.

SUMMARY OF THE INVENTION

An oil dispensing beard comb includes a body, and a plurality of teeth extending outwards from a lower portion of the body. The plurality of teeth may have a plurality of oil dispensing openings therein. A pump may be carried by an upper portion of the body, and an oil bottle may be coupled to the pump. The body may have at least one passageway therein extending between the pump and the plurality of oil dispensing openings in the plurality of teeth.

The oil bottle may be aligned with the pump along the upper portion of the body, and outer exposed surfaces of the oil bottle and the pump may be curved so as to advantageously define a hand grip. Instead of the oil bottle simply being used for holding oil, the oil bottle is now an integral part of the beard comb.

The plurality of teeth may include a plurality of conduits therein, with each conduit extending between the at least one passageway and a respective oil dispensing opening. Each respective oil dispensing opening may be at a medial location of the tooth. Alternatively, each respective oil dispensing opening may be above or below the medial location of the tooth. A portion of the plurality of teeth may be devoid of an oil dispensing opening therein.

The plurality of teeth may have a plurality of oil collection grooves on outer surfaces thereof, with each oil collection groove adjacent a respective oil dispensing opening.

The oil bottle may be coupled to the pump via a threaded connection. The pump may comprise a plunger to interface with the oil bottle, and a push button may be coupled to the plunger. The push button may include an opening that is to receive oil from the oil bottle as the push button is pushed. When the opening is aligned with the at least one passageway in the body, the oil is directed to the at least one passageway.

Another aspect is directed to a liquid dispensing beard comb comprising a body, a plurality of teeth extending outwards from a lower portion of the body. The plurality of teeth may include a plurality of liquid dispensing openings therein, and a plurality of conduits interfacing with the plurality of liquid dispensing openings. A reservoir chamber may be carried by the body, and a liquid bottle may be coupled to the reservoir chamber. The body may have at least one passageway therein extending between the reservoir chamber and the plurality of conduits in the plurality of teeth.

Another aspect is directed to a method for making an oil dispensing beard comb as described above. The method may comprise forming a body with a plurality of teeth extending outwards from a lower portion of the body, with the plurality of teeth having a plurality of oil dispensing openings therein. The method may further comprise coupling a pump to an upper portion of the body, and coupling an oil bottle to the pump. The body may be formed to have at least one passageway therein extending between the pump and the plurality of oil dispensing openings in the plurality of teeth.

DETAILED DESCRIPTION OF THE PREFERRED EMBODIMENTS

Figure 1:
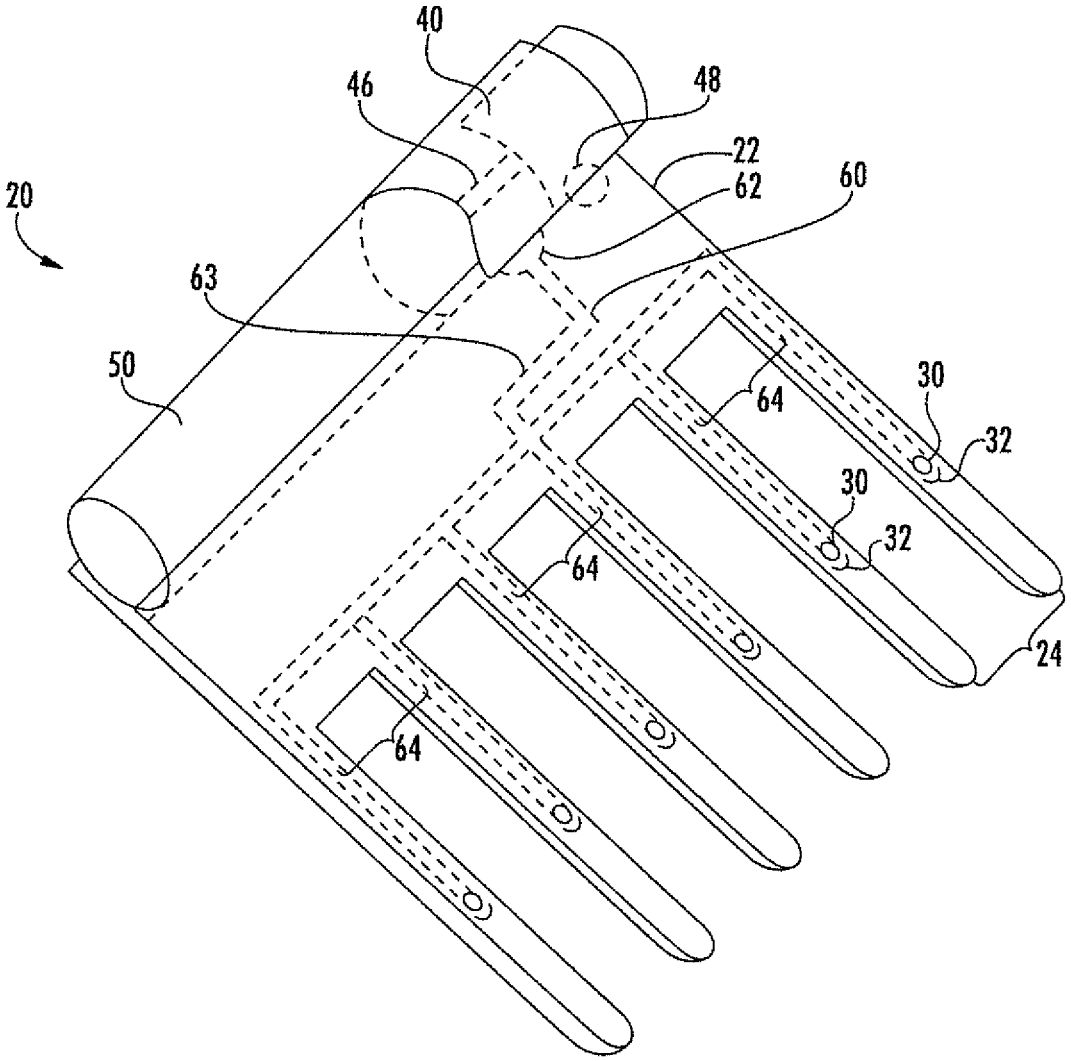
FIG. 1 is a perspective view of an oil dispensing beard comb in accordance with the present invention.
Figure 2:
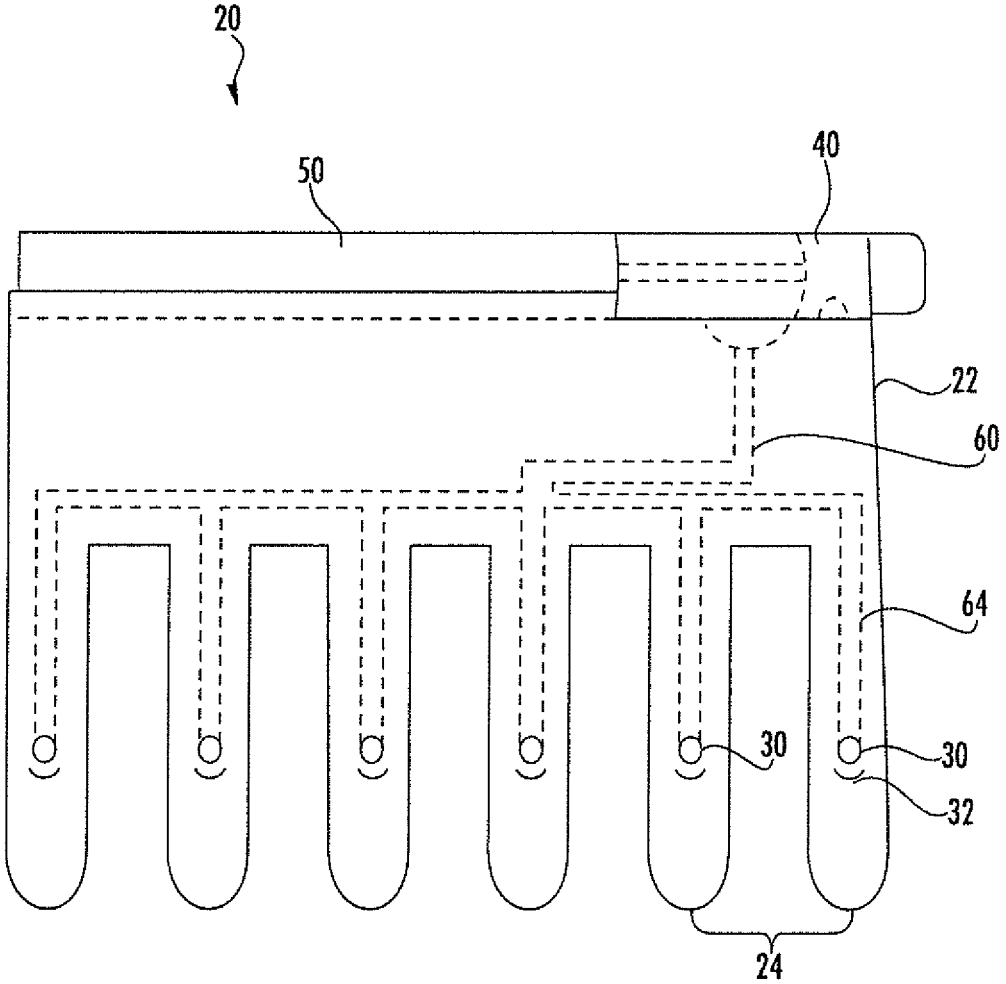
FIG. 2 is a side view of the oil dispensing beard comb illustrated in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and double prime notations refer to alternate embodiments.

Referring now to FIGS. 1-6, an oil dispensing beard comb 20 will be discussed. The oil dispensing beard comb 20 includes a body 22, and a plurality of teeth 24 extending outwards from a lower end of the body. Each tooth 24 has an oil dispensing opening 30 therein. A pump 40 is carried by an upper end of the body 22. An oil bottle 50 is carried by the upper end of the body 22 and is coupled to the pump 40 to define a hand grip for a user. The body 22 and the teeth 24 have passageways 60 therein coupled between the pump 40 and the oil dispensing openings 30.

To provide a low profile and compact beard comb 20, the oil bottle 50 is positioned so that it is advantageously used to define a hand grip for the user. Instead of the oil bottle 50 simply being used for holding oil, the oil bottle is now an integral part of the beard comb 20.

As readily appreciated by those skilled in the art, the oil bottle 50 may also be referred to as a treatment fluid bottle or simply a liquid bottle. Treatment fluid includes oils, as well as other liquids, to be used on the beard and underlying skin. The other liquids, for example, may be tonic, gel and hair dye.

Figure 3:
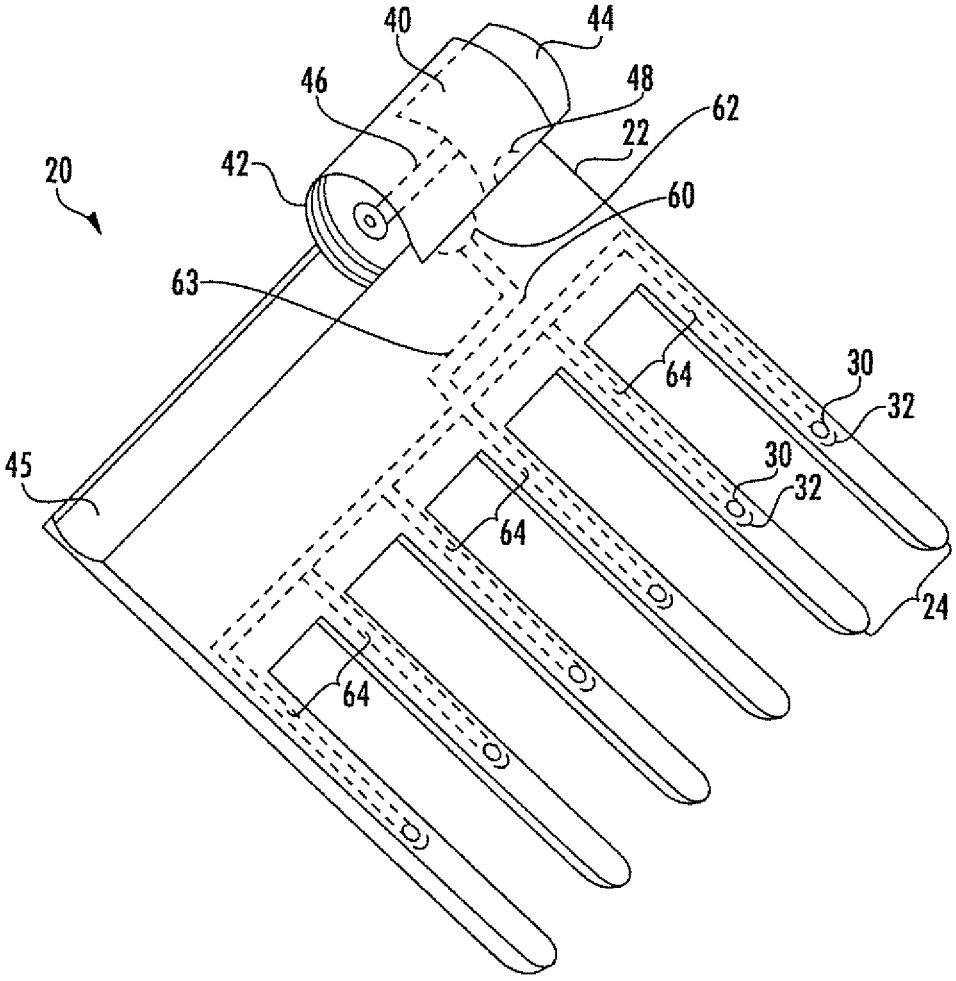
FIG. 3 is a perspective view of the oil dispensing beard comb illustrated in FIG. 1 without the oil bottle.
Figure 4:
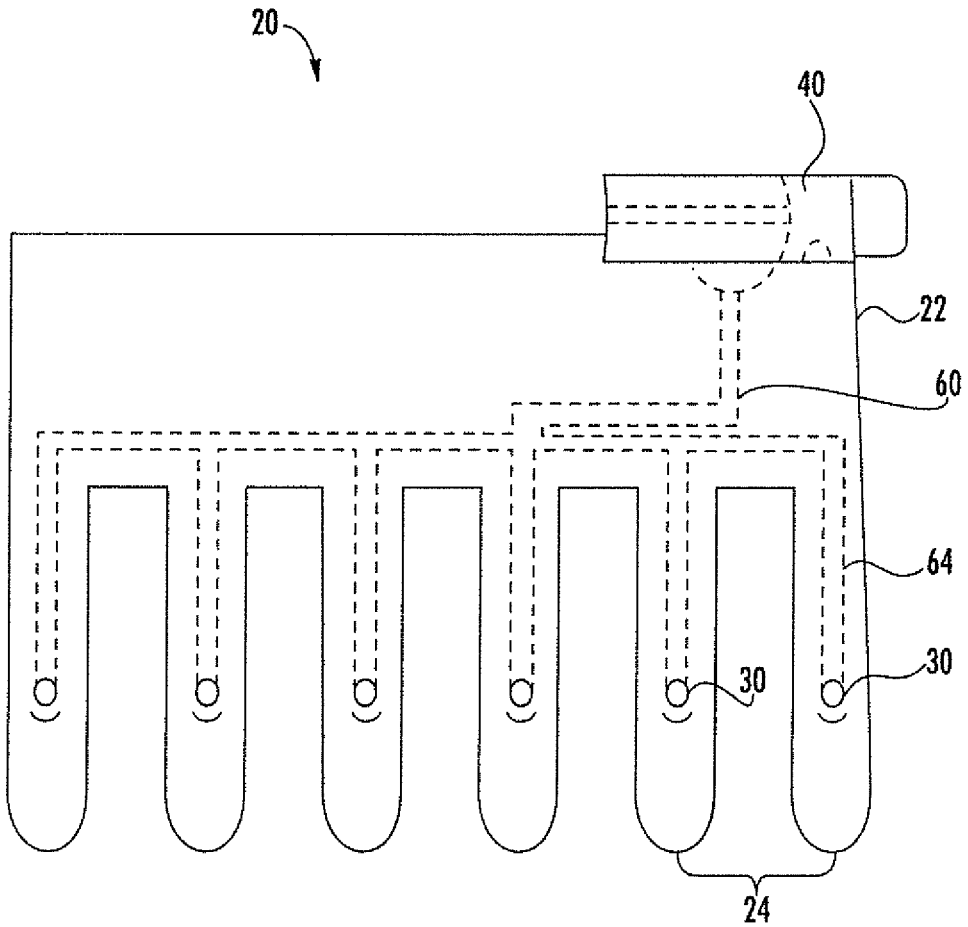
FIG. 4 is a side view of the oil dispensing beard comb illustrated in FIG. 1 without the oil bottle.

The oil bottle 50 is coupled to the pump 40 via a threaded connection 42, as illustrated in FIG. 3. The pump 40 is carried by an upper end of the body 22 and may be configured as a piston pump. The piston pump includes a push button 44 coupled to a plunger 46. As the push button 44 is pushed, the plunger 46 pulls oil from the oil container 50 to an opening 48 in the push button 44. When oil is within the plunger 46, the oil is directed to an opening 62 to the passageways 60 through an opening 48 in the push button 44. The oil is thus provided to the passageways 60 when the opening 48 in the push button 44 is aligned with the opening 62 to the passageways 60.

The illustrated passageways 60 within the body 22 originate as a single body conduit 63 from the opening 62. The single body conduit 63 then branches out to a plurality of teeth conduits 64. The plurality of teeth conduits 64 correspond to the plurality of teeth 24. Each tooth 24 may have its own tooth conduit 64, as illustrated in FIG. 1.

Alternatively, it is not necessary for each tooth 24 to have a tooth conduit 64 and a corresponding oil dispensing opening 30. In other embodiments, the teeth conduits 64 and corresponding oil dispensing openings 30 may be spaced out so that they are in every other tooth 24, as illustrated by the oil dispensing beard comb 20' in FIG. 6, or the teeth conduits 64 and corresponding oil dispensing openings 30 may be in the middle or center teeth only.

Each tooth conduit 64 extends to a respective oil dispensing opening 30 within the tooth 24. The illustrated oil dispensing openings 30 are at a medial location on the teeth 24. Alternatively, the oil dispensing openings 30 may be positioned above or below the medial locations of the teeth 24.

The oil from the oil dispensing opening 30 is released onto a surface area of the tooth 24. Adjacent each oil dispensing opening 30 is an oil collection groove 32. The oil collection groove 32 allows the oil exiting the oil dispensing opening 30 to pool rather than simply stream down the tooth 24.

The body 22 and the teeth 24 may be formed out of plastic. Alternatively, other materials may be used, as readily appreciated by those skilled in the art. The other materials include metals, such as aluminum, for example, and a poly jet resin material used in 3D printed objects.

Figure 5:
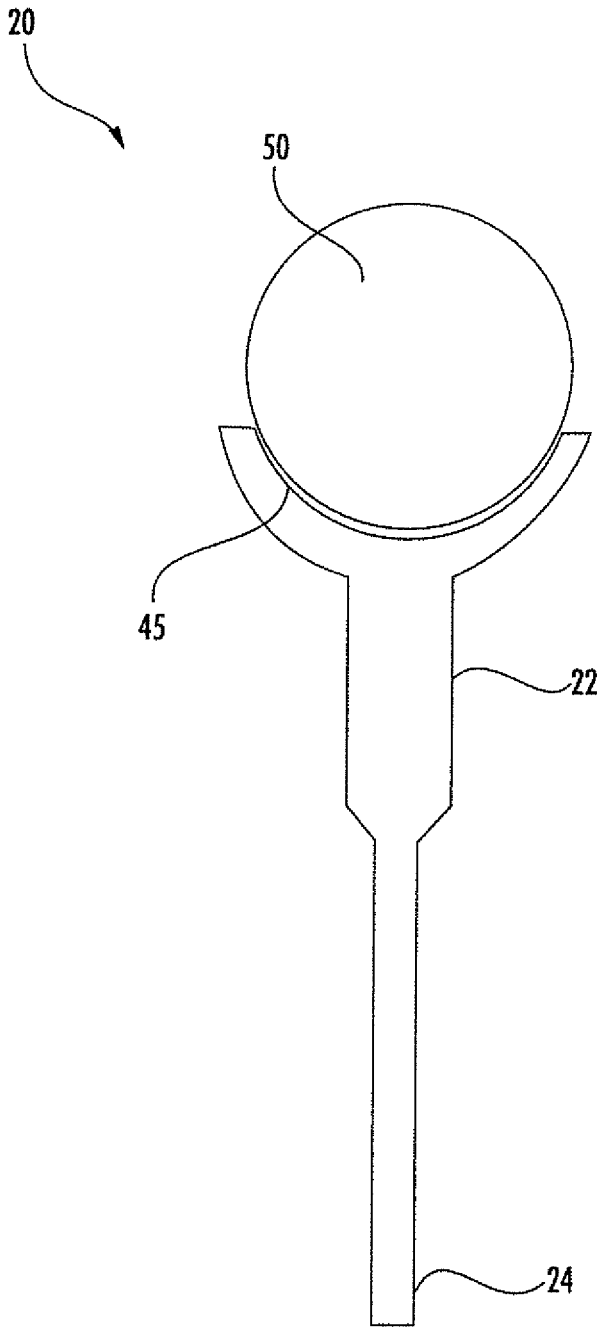
FIG. 5 is an end view of the oil dispensing beard comb illustrated in FIG. 1.
Figure 6:
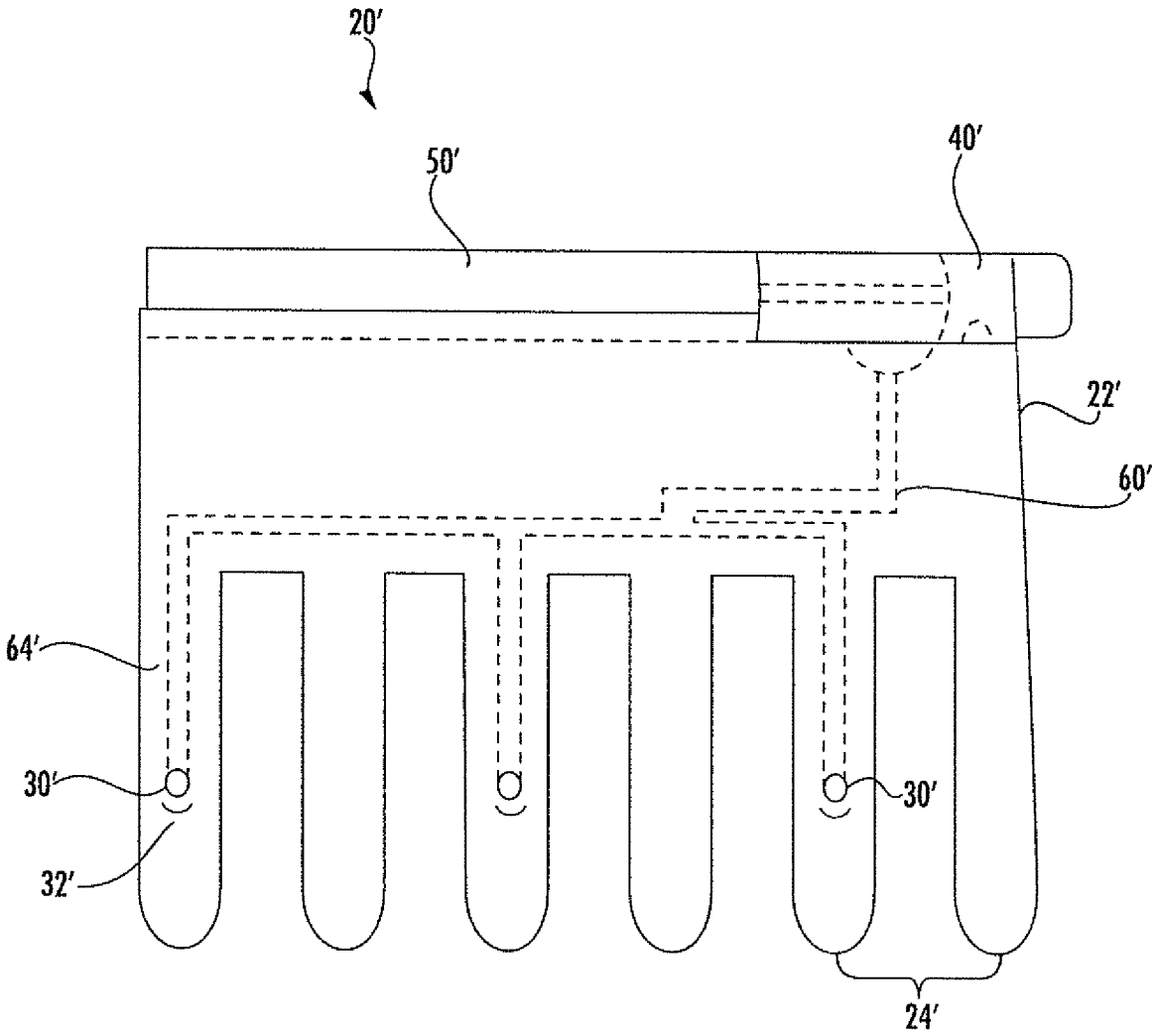
FIG. 6 is a side view of an alternate embodiment of the oil dispensing beard comb illustrated in FIG. 1.

Depending on the material, compression molding or injection molding may be used to form the oil dispensing beard comb 20. The body 22 and the teeth 24 may be formed as one piece, i.e., a unitary or monolithic unit. Tips of the teeth 24 may be curved, for example. The portion 45 of the upper end of the body 22 that receives the oil bottle 50 is curved or recessed, as best illustrated in FIG. 5. In particular, the oil bottle 50 is aligned with the pump 40 along the upper portion of the body. Outer exposed surfaces of the oil bottle 50 and the pump 40 are curved so as to define a hand grip.

Figure 7:
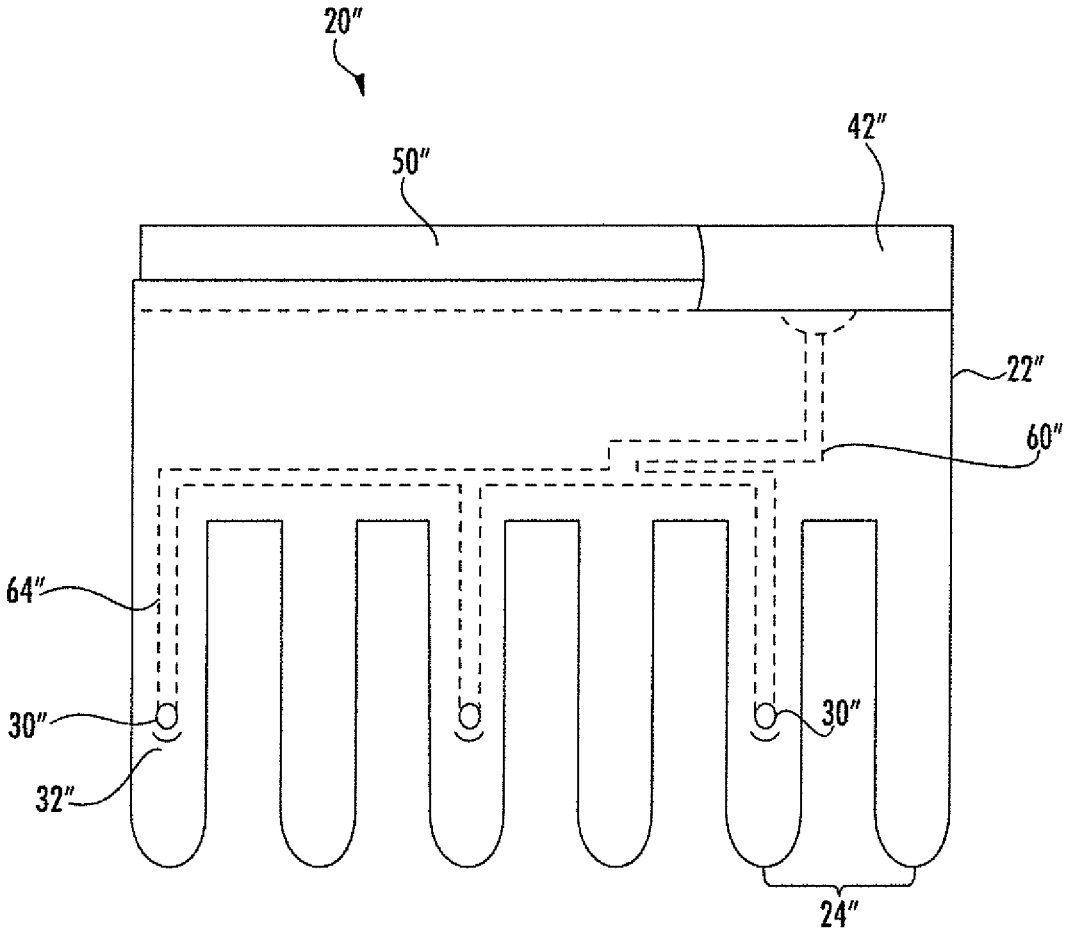
FIG. 7 is a side view of another alternate embodiment of the oil dispensing beard comb illustrated in FIG. 1.

Another embodiment of the oil dispensing beard comb 20" will be discussed in reference to FIG. 7. In this embodiment, the pump is replaced with a reservoir chamber 42". More particularly, the illustrated liquid dispensing beard comb 20" includes a body 22", and a plurality of teeth 24" extending outwards from a lower portion of the body. The plurality of teeth 24" have a plurality of oil dispensing openings 30" therein.

The reservoir chamber 42" is carried by an upper portion of the body 22". A liquid bottle 50" is coupled to the reservoir chamber 42". The body 22" has at least one passageway 60" therein extending between the reservoir chamber 42" and the plurality of oil dispensing openings 30 in the plurality of teeth 24". The reservoir chamber 42", the body 22" and the plurality of teeth 24" may be formed as one piece.

The liquid bottle 50" is aligned with the reservoir chamber 42" along the upper portion of the body 22". The outer exposed surfaces of the liquid bottle 50" and the reservoir chamber 42" are curved so as to define a hand grip.

The liquid bottle 50" is coupled to the reservoir chamber 42" via a threaded connection, similar to the threaded connection illustrated in FIG. 3. When the reservoir chamber 42" receives the liquid from the liquid bottle 50", the liquid may then be directed to the illustrated passageway 60" provided the comb 20" is titled at the appropriate angle. Alternatively, when the comb 20" is not in use, the liquid may be directed away from the illustrated passageway 60" by tilting the comb 20" at a different angle. In other embodiments, the liquid dispensing beard comb 20" may include a back flow valve in the reservoir chamber 42" or in the passageway 60" so as to prevent the liquid from flowing back into the reservoir chamber.

Figure 8:
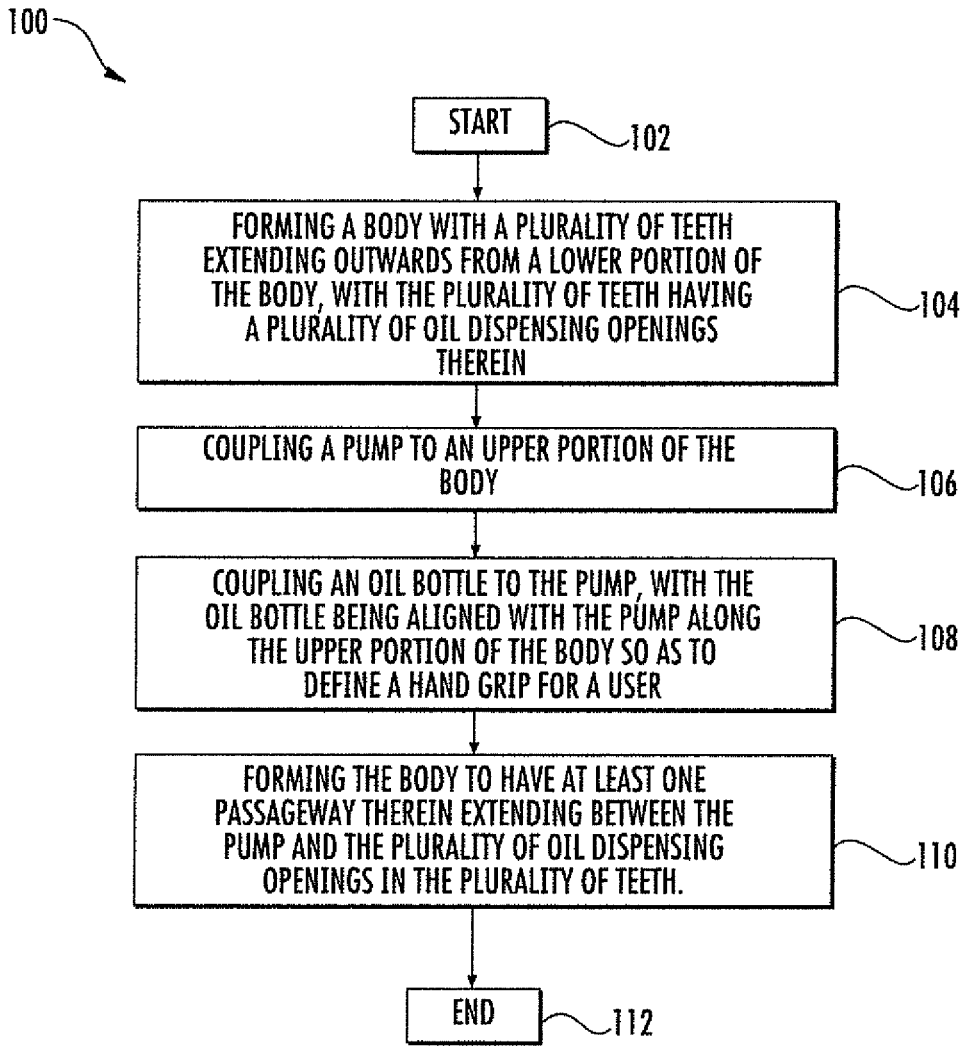
FIG. 8 is a flowchart illustrating a method for making the oil dispensing beard comb illustrated in FIG. 1.

Another aspect is directed to a method for making the above described oil dispensing beard comb 20. Referring to the flowchart 100 in FIG. 8, from the start (Block 102), the method comprises forming a body 22 with a plurality of teeth 24 extending outwards from a lower portion of the body at Block 104. The plurality of teeth 24 have a plurality of oil dispensing openings 30 therein. A pump 40 is coupled to an upper portion of the body 22 at Block 106. An oil bottle 50 is coupled to the pump 40 at the upper portion of the body 22 at Block 108. The oil bottle 50 is aligned with the pump 40 along the upper portion of the body 22 so as to define a hand grip for a user. The method further includes forming the body 22 to have at least one passageway 60 therein extending between the pump 40 and the plurality of oil dispensing openings 30 in the plurality of teeth 24 at Block 110. The method ends at Block 112.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included.

That which is claimed:

1. An oil dispensing beard comb comprising:

a body, the body having a first end and a second opposing end, an upper portion and a lower portion extending horizontally from the upper portion, the upper portion and the lower portion extending between the first end and the second opposing end, an outermost surface of the upper portion comprising an exposed curved recess area having a semi-circular shape and a circular recess;

a plurality of teeth aligned in a single row and extending from the lower portion in a direction that is orthogonal to the horizontal direction, wherein at least a portion of the plurality of teeth have a respective oil dispensing opening therein, wherein a first outermost tooth of the plurality of teeth being aligned with the first end and a second outermost tooth of the plurality of teeth being aligned with the second opposing end;

a pump carried by the circular recess so that said pump is aligned over a first area of said plurality of teeth that includes the first outermost tooth;

a removable oil bottle coupled to said pump via a threaded connection within the circular recess, a portion of the removable oil bottle carried by the exposed curved recess area so that said oil bottle is aligned over a second area of said plurality of teeth that includes the second outermost tooth;

said body having at least one passageway therein extending between said circular recess and each respective oil dispensing opening and said pump and said oil bottle extending between the first end and second opposing end and said oil bottle being exposed so as to define a handgrip for a user of the oil dispensing beard comb wherein said pump comprises a plunger to interface with said oil bottle, and a push button coupled to said plunger, with said push button includes an opening that is to receive oil form said oil bottle as said push button is pushed, and when said opening is aligned with the at least one passageway in said body, the oil is directed to the at least one passageway.

2. The oil dispensing beard comb according to claim 1 wherein an outer exposed surface of said oil bottle and said pump are curved so as to define the hand grip.

3. The oil dispensing beard comb according to claim 1 wherein each tooth of the portion of the plurality of teeth having the respective oil dispensing opening further has a conduit extending between the at least one passageway and the respective oil dispensing opening.

4. The oil dispensing beard comb according to claim 3 wherein each respective oil dispensing opening is at a medial location of said tooth.

5. The oil dispensing bear comb according to claim 1 wherein each tooth of the portion of the plurality of teeth having the respective oil dispensing opening further has an oil collection groove on an outer surface thereof, with the oil collection groove being adjacent the respective oil dispensing opening.

6. The oil dispensing beard comb according to claim 1 wherein at least a second portion of the plurality of teeth are devoid of an oil dispensing opening.

7. The oil dispensing beard comb according to claim 1 wherein said body and said plurality of teeth are formed as one piece.

8. A liquid dispensing beard comb comprising:

a body, the body having a first end and a second opposing end, an upper portion and a lower portion extending horizontally from the upper portion, the upper portion and the lower portion extending between the first end and the second opposing end, an outermost surface of the upper portion comprising an exposed curved recess area having a semi-circular shape and a circular recess;

a plurality of teeth aligned in a single row and extending from the lower portion in a direction that is orthogonal to the horizontal direction, with a first outermost tooth and a second outermost tooth of the plurality of teeth being aligned with the first end and the second opposing end, and with at least a portion of the plurality of teeth each having the following:

a liquid dispensing opening therein, and a conduit interfacing with the liquid dispensing opening;

a pump carried by the circular recess so that said pump is aligned over a first area of said plurality of teeth that includes the first outermost tooth;

a removable liquid bottle coupled to said pump and carried by the exposed curved recess area so that said liquid bottle is aligned over a second area of said plurality of teeth that includes the second outermost tooth;

said pump and said liquid bottle extending between the first end and the second opposing end so as to define a handgrip for a user of the liquid dispensing beard comb; and said body having at least one passageway therein extending between said circular recess and each conduit wherein said pump comprises a plunger to interface with said liquid bottle, and a push button coupled to said plunger, with said push button includes an opening that is to receive liquid form said liquid bottle as said push button is pushed, and when said opening is aligned with the at least one passageway in said body, the liquid is directed to the at least one passageway.

9. The liquid dispensing beard comb according to claim 8 wherein an outer exposed surface of said liquid bottle and said pump are curved so as to define the hand grip.

10. The liquid dispensing beard comb according to claim 8 wherein each tooth of the portion of the teeth having the respective liquid dispensing opening further has a liquid collection groove on an outer surface thereof, and the liquid collection groove being adjacent the respective liquid dispensing opening.

11. The liquid dispensing beard comb according to claim 8 wherein at least a second portion of the plurality of teeth are devoid of a liquid dispensing opening.

* * * * *